United States Patent [19]

Meierling

[11] Patent Number: 4,978,105

[45] Date of Patent: Dec. 18, 1990

[54] STEEL MILL SYSTEM WHICH INCLUDES A METALLURGICAL FURNACE AND A FURTHER PROCESSING SYSTEM

[75] Inventor: Peter Meierling, Düsseldorf, Fed. Rep. of Germany

[73] Assignee: Krupp Industrietechnik GmbH, Duisburg, Fed. Rep. of Germany

[21] Appl. No.: 399,120

[22] Filed: Aug. 25, 1989

[30] Foreign Application Priority Data

Aug. 26, 1988 [DE] Fed. Rep. of Germany ..... 3828962

[51] Int. Cl.[5] ..... C21B 7/00

[52] U.S. Cl. ..... 266/143; 266/276

[58] Field of Search ..... 266/143, 165, 276; 164/335, 337; 222/591

[56] References Cited

U.S. PATENT DOCUMENTS 4,345,747 8/1982 Laimer ..... 266/276

FOREIGN PATENT DOCUMENTS 1038239 3/1976 Japan ..... 266/276

*Primary Examiner*—S. Kastler

*Attorney, Agent, or Firm*—Spencer & Frank

[57] ABSTRACT

A steel mill system includes a metallurgical furnace and a further processing system such as a continuous casting system and/or one or more stations for treatment of the steel melt. At least one steel ladle is loaded with steel melt below the metallurgical furnace and is moved between the metallurgical furnace and the further processing system. The steel melt is then emptied into the further processing system. In the region of its upper half, the steel ladle is equipped with a carrying mechanism which includes diametrically oppositely disposed running wheels. The steel ladle is movable in a suspended position between the metallurgical furnace, and the further processing system on rails which are adapted to the carrying mechanism.

12 Claims, 3 Drawing Sheets

FIG. 3
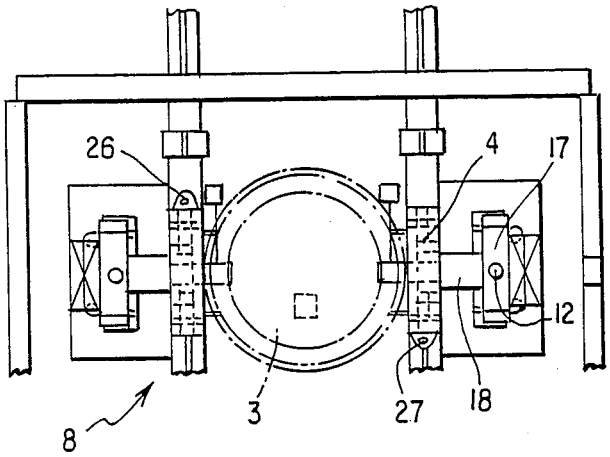
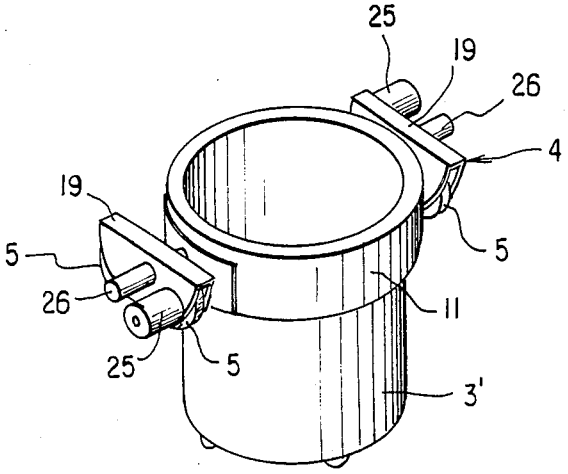
FIG. 4
FIG. 5
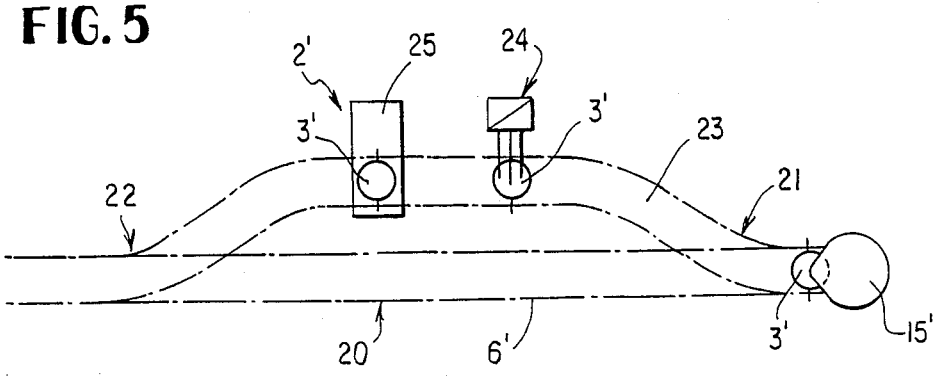

STEEL MILL SYSTEM WHICH INCLUDES A METALLURGICAL FURNACE AND A FURTHER PROCESSING SYSTEM

CROSS REFERENCE TO RELATED APPLICATIONS

This application claims the priority of application Ser. No. P 38 28 962.8, filed Aug. 26th, 1988 in the Federal Republic of Germany.

BACKGROUND OF THE INVENTION

The present invention relates to a steel mill system including a metallurgical furnace and at least one further processing system for the steel melt, with at least one steel ladle being disposed below the metallurgical furnace. This ladle can be loaded with the steel melt from the metallurgical furnace and moved between the metallurgical furnace and the further processing system on rails adapted to a carrying mechanism, with the ladle being emptied into the further processing system. The further processing system may include, for example, a continuous casting system. The term steel "ladle" identifies an appropriate vessel which has an outlet at the bottom, for example equipped with a slide arrangement, or which can be emptied by tilting. A converter or a thermal device for heating or maintaining the temperature of the melt in the steel ladle may be connected between the furnace and the casting system.

In the prior art steel mill system on which the present invention is based, the steel ladle can be moved between the metallurgical furnace and the further processing system by being placed onto a special steel ladle carriage which is configured as a self-propelled vehicle or which is drawn (see U.S. Pat. No. 4,061,179; German Offenlegungsschrift No. [unexamined, published patent application] 3,245,382). A traveling crane having a movable bridge serves to place the steel ladle onto the ladle carriage and to advance the steel ladle to the further processing system. This is expensive with respect to the machinery required and results in annoying dead times in operation, particularly since introduction of the steel ladle into the steel ladle carriage and removal of the steel ladle from the steel ladle carriage is complicated. The procedure is similar for the transport of refinery vessels (German Auslegeschrift No. [examined, published patent application] 1,508,295).

Additionally, U.S. Pat. No. 3,459,312 discloses a steel ladle carriage in which the ladle is suspended in such a manner that its lowermost end projects from the carriage. For that reason, rails on which the carriage travels are higher than the mill floor—i.e., are arranged on stands. Moreover, as in the other prior art steel ladle carriages, the ladle suspended from its two carrying pins is placed into the carriage and lifted out of it by means of a crane.

SUMMARY OF THE INVENTION

It is an object of the present invention to improve a steel mill system of the above described design so that the movement of the steel ladle from the metallurgical furnace to the further processing system can be performed easily, reliably, and quickly.

To solve this problem, the invention teaches that, in the region of its upper half, a steel ladle is equipped with a carrying mechanism which is provided with diametrally oppositely disposed running wheels. According to the invention, the steel ladle or ladles hang, so to speak, directly from the rails. They are therefore easily and reliably accelerated, moved, and braked. An embodiment employing a plurality of steel ladles provides a preferred steel mill system according to the invention, which is characterized in that the rails form a transporting circuit and the steel ladles are circulated. In an embodiment having a plurality of steel ladles which are supplied to the further processing system, the rails may also be provided as a linear transporting path with bypass arcs connected by way of switches, and the system may be equipped for back and forth movement of the individual steel ladles. An electric motor drive integrated in the steel ladles may be employed to move the steel ladle or ladles on the rails. The electric motor drive may be removable so as to facilitate work on the steel ladle. One embodiment, distinguished by simplicity and operational reliability, is characterized in this connection in that the rails are equipped with a pulling means drive and the steel ladle or the individual steel ladles can be coupled to the pulling means as is customary, for example, in cable car operations or in mines.

In a steel mill, the stations of the further processing system may be provided at the same level as the rails for receiving the steel ladles, or they may be disposed considerably higher than the rails. In the embodiment in which the further processing system is higher than the rails and the steel ladle must be lifted to supply the further processing system, the invention recommends associating a lifting apparatus with the further processing system with which the steel ladles can be lifted to the level of the further processing system. The lifting apparatus may be configured, for example, in the manner of an elevator. It picks up the steel ladle and is driven, for example, by way of spindle drives or by hydraulic or pneumatic cylinder-piston arrangements. In this connection, it is recommended that the drive means be arranged in such a manner that the steel ladles can be transferred on supply rails from the lifting apparatus to the further processing system. If the steel ladles are circulated, another embodiment is recommended which is characterized by the fact that the supply rails lead from the lifting apparatus to a lowering apparatus for the steel ladle or ladles, with the lowering apparatus transferring the steel ladles to the rails and being of similar configuration as the lifting apparatus. Moreover, the lifting apparatus may also operate as a lowering apparatus.

Within the scope of the invention, the steel ladles require no special configuration. They may be constructed in the proven manner. With the basically known structure, however, each ladle is preferably arranged in such a manner that it has a trunnion ring in the region of its upper edges and that the running wheels are connected to trunnion rings so that they are disposed at a height which is about $\frac{3}{4}$ of the height of the steel ladle. Preferably, the carrying mechanism has two running wheels on each side so that the driving dynamics of the steel ladle can be stabilized without difficulty.

BRIEF DESCRIPTION OF THE DRAWINGS

FIG. 3 is a top plan view of a steel ladle in the lifting apparatus shown in FIG. 2.

FIG. 4 is a perspective view of a slightly modified steel ladle, which has a built-in motor drive.

FIG. 5 is a top plan view illustrating a schematic representation of a steel mill system according to another embodiment of the invention.

DESCRIPTION OF THE PREFERRED EMBODIMENTS

Figure 1:
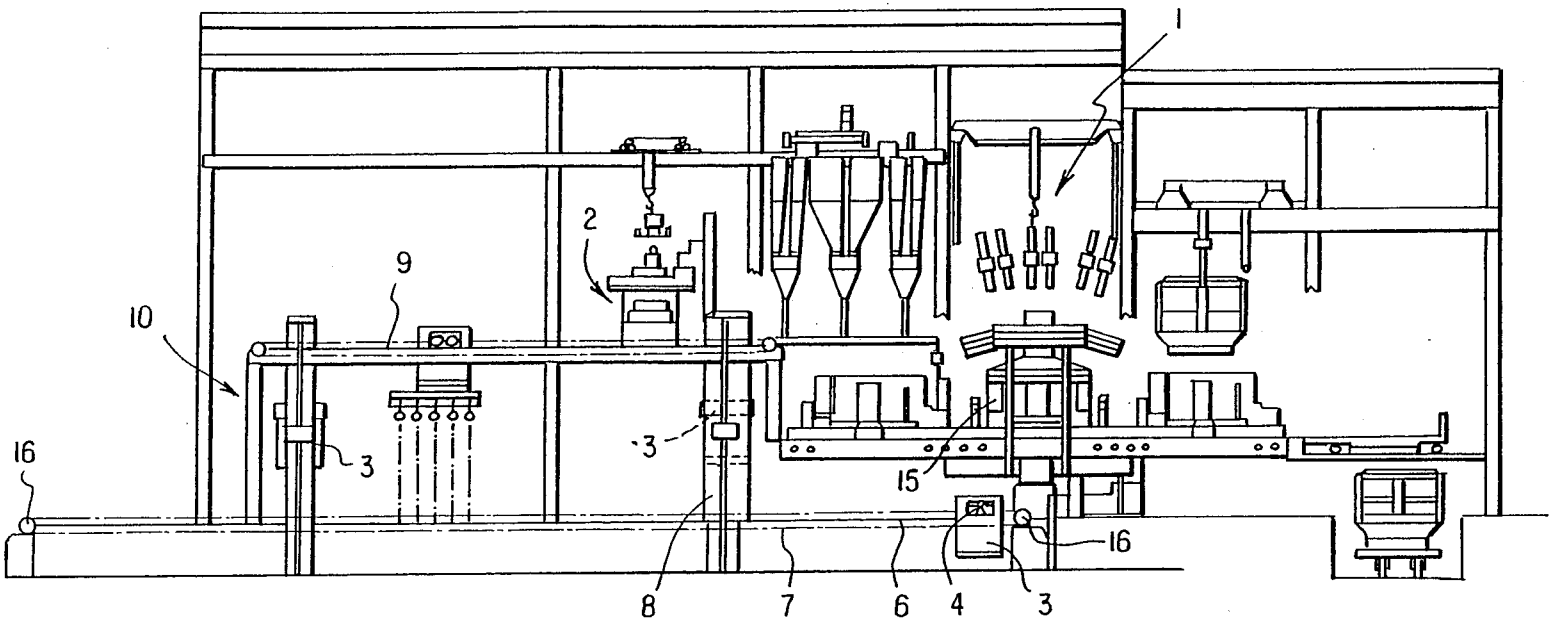
FIG. 1 is a side view illustrating a schematic representation of a steel mill system according to the invention.

The steel mill system shown in FIG. 1 is equipped with a metallurgical furnace 1, such as an electric arc furnace having a furnace vessel 15, and a further processing system 2, such as a continuous casting system. As shown for receiving steel melt and/or a converter (not shown) or a ladle furnace (not shown) for fine tuning the melt. A steel ladle 3 can be moved to a loading position beneath furnace 1 to receive steel melt from furnace vessel 15, which has a "bay discharge" or lateral bottom discharge opening (not illustrated) for transferring the steel melt. The filled steel ladle 3 can then be moved from furnace 1 to a processing position at further processing system 2, as will be discussed. Steel ladle 3 can then be emptied into further processing system 2.

The upper half of a steel ladle 3 is equipped with a carrying mechanism 4 having diametrally oppositely disposed running wheels 5, which ride on rails 6. The embodiment illustrated in FIGS. 1–3 employs linear movement of steel ladles 3 (that is, they move along paths which are composed of straight segments). The rails 6, for example, provide a linear transporting track. The rails 6 are equipped with driven pulling means for moving the steel ladles 3. The pulling means includes an endless chain 7 (shown using a dot-dash line) which is stretched between rollers 16 (see FIG. 1), one of which is driven by a motor (not illustrated). Another chain (not illustrated) is disposed parallel to chain 7 on the other side of rails 6. The steel ladles 3, or each individual steel ladle 3, can be coupled to the pulling means. For this purpose, the carrying mechanism 4 of each ladle 3 is provided with coupling means 26 and 27 into which vertically movable pins can be inserted so as to engage the links of chains 7, thereby permitting the chains 7 to be selectively connected to or disconnected from the respective steel ladle 3.

Figure 2:
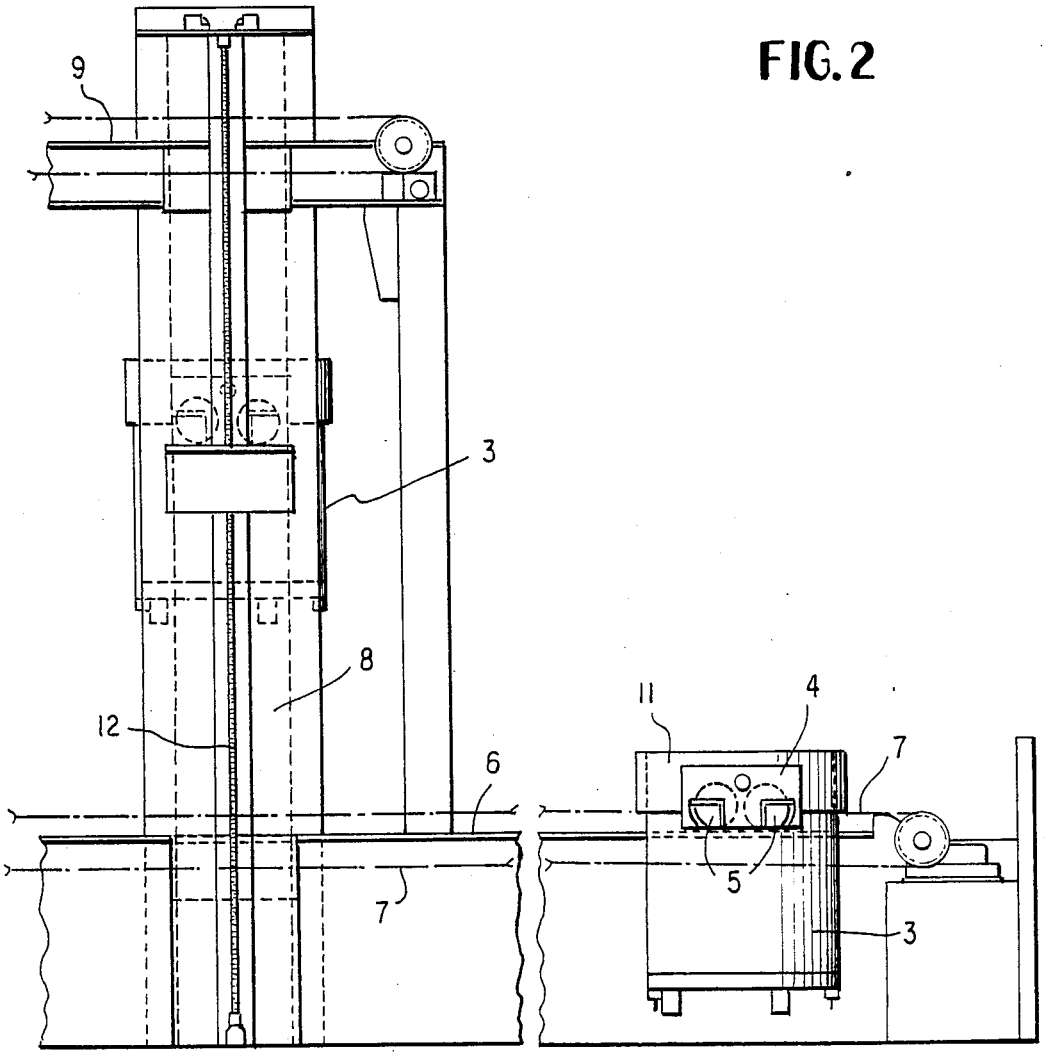
FIG. 2 is a side view of a portion of the steel mill system shown in FIG. 1, and shows the rails, steel ladles, and a lifting apparatus.

As is shown in FIG. 1, further processing system 2 is disposed higher than rails 6. Consequently, in order to reach further processing system 2, a steel ladle 3 must be lifted. A comparison between FIGS. 1 and 2 indicates that further processing system 2 has an associated lifting apparatus 8 with which the steel ladles 3 can be lifted to the height of further processing system 2. FIG. 2 further shows that steel ladle 3 can be transferred from lifting apparatus 8 to supply rails 9 of further processing system 2. Supply rails 9 are connected to lifting apparatus 8. Supply rails 9 also communicate with a lowering apparatus 10 for the steel ladles 3 so that the steel ladles 3 can be placed back onto rails 6.

Each steel ladle 3 is equipped with a trunnion ring 11 in such a manner that the running wheels 5 are arranged at a height of about $\frac{3}{4}$ of the height of steel ladle 3, with the trunnion ring 11 supporting carrying mechanism 4. Two running wheels 5 are disposed on each side of a steel ladle 3 to impart stability. Lifting apparatus 8 operates with threaded spindles 12, which cooperate with carriage members 17 (see FIG. 3) having threaded bores to receive the spindles 12. The carriage members 17 may be provided with brackets 18 that can be telescoped towards ladle 3 in order to support the carrying mecha-nism 4 of a ladle 3 outside of wheels 5. Spindles 12 are rotated in such a manner that it is possible to raise or lower a steel ladle 3 that has been picked up.

It will be apparent that the steel mill system shown in FIG. 1 employs a transporting circuit for the steel ladles 3 that is disposed in a vertical plane. In contrast, the transporting circuit of the steel mill system shown schematically in FIG. 5 is disposed in a horizontal plane.

In FIG. 5, a furnace vessel 15′ having a bay discharge is disposed above a linear transporting track 20 provided by rails 6′. Further rails provide an alternate arc 23 that is selectively connected to transporting track 20 by way of switches 21 and 22. Transporting track 20 and alternate arc 23 lie in the same horizontal plane. Further processing system 2′, such as the casting station 25 of a continuous casting system and an additional heating station 24 are disposed along alternate arc 23. Although not shown, further processing system 2′ could also include alloying stations, oxygen treatment stations, and everything which is part of what is known as "ladle metallurgy."

The steel ladles 3′ employed in the steel mill system of FIG. 5 are very similar to the steel ladles 3 used in the first embodiment, the difference being in the way they are moved along the tracks. As is shown in FIG. 4, a steel ladle 3′ has a trunnion ring 11 to which the wheel assemblies 19 of carrying mechanism 4 are attached. Each wheel assembly 19 includes a pair of wheels 5. Stubs 26 are provided so that a crane harness (not shown) can lift ladle 3′. While the ladle 3 in the first embodiment was moved along the rails by selectively connecting it to moving chains, ladle 3′ is provided with flanged-on drive motors 25 (such as gear motors) to rotate the wheels 5.

Furnace vessels 15 (FIG. 1) and 15′ (FIG. 5) have been described as bay discharge furnace vessels, but furnace vessels having laterally projecting pouring spouts which discharge steel melt when the vessels are tilted could be used instead. In the first embodiment, instead of a lifting apparatus 8 with telescoping brackets 18 as shown in FIG. 3, each carriage mechanism 17 could include a respective rail segment to support the wheels 5, with the rail segments being positioned at a gap in rails 6 and being aligned with the rails 6 when lifting apparatus 8 is in its lower position and with the rail segments being positioned at a gap in rails 9 and being aligned with the rails 9 when lifting apparatus 8 is in its upper position.

It will be understood that the above description of the present invention is susceptible to various modifications, changes, and adaptations, and the same are intended to be comprehended within the meaning and range of equivalents of the appended claims.

What I claim is:

1. A steel mill system, comprising:

a metallurgical furnace to produce steel melt;

a further processing system for the steel melt;

a steel ladle having an upper half and a lower half, the upper half of the steel ladle having a carrying mechanism which includes diametrically oppositely disposed running wheels; and means guiding the ladle for movement along a path having a lower portion with a loading position beneath the furnace and having an upper portion with a processing position adjacent the further processing system, steel melt being loaded into the ladle when the ladle is disposed at the loading position and the steel melt being supplied to the further processing system when the ladle is disposed at the processing position, the means guiding the ladle including rails which carry the wheels and lifting apparatus means for lifting the ladle from the lower portion of the path to the upper portion of the path.

2. The steel mill system of claim 1, wherein the path is a transporting circuit formed by the rails, and further comprising at least one additional steel ladle, the ladles being circulated along the transporting circuit.

3. The steel mill system of claim 1, wherein the path has a linear transporting portion formed by the rails, wherein the means guiding the ladle further includes switches and a bypass are connected by way of the switches, wherein the steel mill system further comprises at least one additional ladle, and wherein the ladles move back and forth along the linear transporting portion of the path.

4. The steel mill system of claim 1, wherein the ladle further includes an electric motor drive.

5. The steel mill system of claim 1, further comprising driven pulling means adjacent the rails for pulling the ladle, the ladle being coupled to the pulling means.

6. The steel mill system of claim 1, wherein the rails are disposed along the lower portion of the path, and wherein the means guiding the ladle further comprises additional rails disposed along the upper portion of the path, the ladle being transferred from the lifting apparatus means to the additional rails as the ladle moves along the path.

7. The steel mill system of claim 6, wherein the means guiding the ladle further comprises lowering apparatus means for lowering the ladle from the additional rails to the rails.

8. The steel mill system of claim 1, wherein the further processing system comprises a continuous casting system.

9. The steel mill system of claim 8, wherein the rails are disposed along the lower portion of the path, and wherein the means guiding the ladle further comprises additional rails disposed along the upper portion of the path, the ladle being transferred from the lifting device means to the additional rails as the ladle moves along the path.

10. The steel mill system of claim 9, wherein the means guiding the ladle further comprises lowering apparatus means for lowering the ladle from the additional rails to the rails.

11. The steel mill system of claim 1, wherein the ladle has a predetermined height and an upper edge, wherein the carrying mechanism of the ladle further comprises a drive ring gear adjacent the upper edge of the ladle, and wherein the running wheels are disposed at a height of about $\frac{3}{4}$ the height of the ladle.

12. The steel mill of claim 1, wherein the ladle includes first and second sides, and wherein there are two running wheels on the first side and two running wheels on the second side to dynamically stabilize the ladle.

* * * * *